US006974086B2

(12) United States Patent
Cheng

(10) Patent No.: US 6,974,086 B2
(45) Date of Patent: Dec. 13, 2005

(54) RAIL BOARDS

(75) Inventor: Chor Chiu Cheng, Shatin (HK)

(73) Assignee: Kin Yat Industrial Company Limited, Kowloon (HK)

( * ) Notice: Subject to any disclaimer, the term of this patent is extended or adjusted under 35 U.S.C. 154(b) by 43 days.

(21) Appl. No.: 10/224,312

(22) Filed: Aug. 21, 2002

(65) Prior Publication Data

US 2003/0057291 A1 Mar. 27, 2003

(30) Foreign Application Priority Data

Sep. 27, 2001 (EP) ..... 01308264

(51) Int. Cl.[7] ..... E01B 23/00
(52) U.S. Cl. ..... 238/10 F
(58) Field of Search ..... 238/10 R, 10 A, 238/10 B, 10 C, 10 E, 10 F; 104/DIG. 1

(56) References Cited

U.S. PATENT DOCUMENTS 4,106,695 A * 8/1978 Carella et al. ..... 238/10 F
4,219,153 A * 8/1980 Cheng ..... 238/10 E
4,286,752 A 9/1981 Cheng
5,405,080 A * 4/1995 Yeung et al. ..... 238/10 F
5,503,330 A * 4/1996 Riley ..... 238/10 E
6,019,289 A * 2/2000 Sung ..... 238/10 E
6,409,091 B1 * 6/2002 Simpson ..... 238/10 A

FOREIGN PATENT DOCUMENTS

DE 29608146 U1 8/1996
DE 29704437 5/1997
GB 2236957 4/1991

* cited by examiner

*Primary Examiner*—S. Joseph Morano
*Assistant Examiner*—Robert J. McCarry, Jr.
(74) *Attorney, Agent, or Firm*—Pillsbury Winthrop Shaw Pittman LLP

(57) ABSTRACT

A rail board has a base and at least one rail extending along the base. A projection extends from a first end of the base and a socket is provided in a surface of the base at the second end thereof. At least part of the projection has an outwardly tapered profile. A method of assembling at least two rail boards having at least one rail includes arranging a first rail board having a projection extending therefrom and a second rail board having a socket formed therein such that the projection of the first rail board faces the socket of the second rail board. Connecting the projection of the first rail board with the socket of the second rail board abuts the first rail board with the second rail board to align at least one rail of the first rail board with at least one rail of the second rail board.

22 Claims, 3 Drawing Sheets

RAIL BOARDS

This application claims priority under 35 U.S.C. from European Application No. 01308264.9, filed Sep. 27, 2001, titled "Improvements in and relating to rail boards," the contents of which are incorporated herein by reference.

BACKGROUND OF THE INVENTION

1. Field of the Invention

The present invention relates to rail boards, in particular, although not exclusively, to rail boards for model vehicles.

2. Background Information

Rails and tracks for use with model vehicles are often assembled from sections in the form of rail boards or track segments. Rail boards generally comprise a base and one or more rails, which may be electrically conductive. Generally, one or both ends of each rail board include an attachment means for connecting the board to another board.

Often, prior art rail boards have sharp rail edges, which makes assembly easier. However, these exposed sharp edges can cause injury when the rail board is handled.

One common rail board design comprises at least one spigot extending from one end of the board and a socket in the other end of the board, the socket having dimensions corresponding to the dimensions of the rail. In use, the spigot of one board is inserted into the socket of another board, to connect the two boards together. However, this type of connection means has a tendency to create a loose connection between adjacent boards. Furthermore, the socket and the spigot may deform or become damaged if the board is dropped or crushed or the like. The deformation may affect the ease of assembly. In some cases, damage to the spigot or socket can prevent connection of the boards.

An alternative rail board design is disclosed in United Kingdom (UK) patent application number 8923646.7, which comprises a protrusion provided by an extended base section that co-operates with a cutaway base section of another board section. In this patent, two adjacent board sections are joined together by pushing the extended base section of one board into the cut away section of the other board. Although the board design of the United Kingdom patent application number 8923646.7 may comprise a neck and barrel arrangement to improve the connection between adjacent boards, the push-fit arrangement for connecting the boards causes the boards to be easily disconnected if the track is accidentally disrupted.

SUMMARY OF THE INVENTION

In an embodiment of the invention, a rail board includes a base having a first and second end and at least one rail extending along the base from the first end thereof to the second end thereof. The base has a portion extending from the first end thereof and a socket provided by an opening formed in a surface of the base at a second end thereof. At least part of the projection has an outwardly tapered profile.

In another embodiment of the invention, a method of connecting a first rail board to a second rail board is provided. The first and second rail boards each comprise a base having a projection extending from one end thereof and a socket formed in an opposite end thereof and at least one rail extending from the one end of the base to the opposite end of the base. The method comprises arranging the first and second rail boards such that the socket of the first rail board faces the projection of the second rail board. The second rail board is aligned relative to the first rail board such that the projection of the second rail board is above the socket of the first rail board. The first rail board is connected to the second rail board by cooperatively engaging the projection of the second rail board with the socket of the first rail board such that one end of the first rail board abuts the opposite end of the second rail board. This connection aligns the at least one rail extending along the first rail board with the at least one rail extending along the second rail board.

Other aspects, features and advantages of the invention will become apparent from the following detailed description and the accompanying drawings.

BRIEF DESCRIPTION OF THE DRAWINGS

The above and other features of the present invention are further described in the detailed description which follows, with reference to the drawings, and by way of a non-limiting embodiments of the invention, wherein like reference numerals represent similar parts of the present invention throughout the several views and wherein:

FIG. 4 further illustrates a section of the first rail board taken along the line D—D of;

DETAILED DESCRIPTION OF THE EMBODIMENTS

The following detailed description of the present invention refers to the accompanying drawings that illustrate embodiments consistent with this invention. Other embodiments are possible and modifications may be made to the embodiments without departing from the spirit and scope of the invention. Therefore, the following detailed description is not meant to limit the invention. Rather the scope of the invention is defined by the appended claims.

Figure 1:
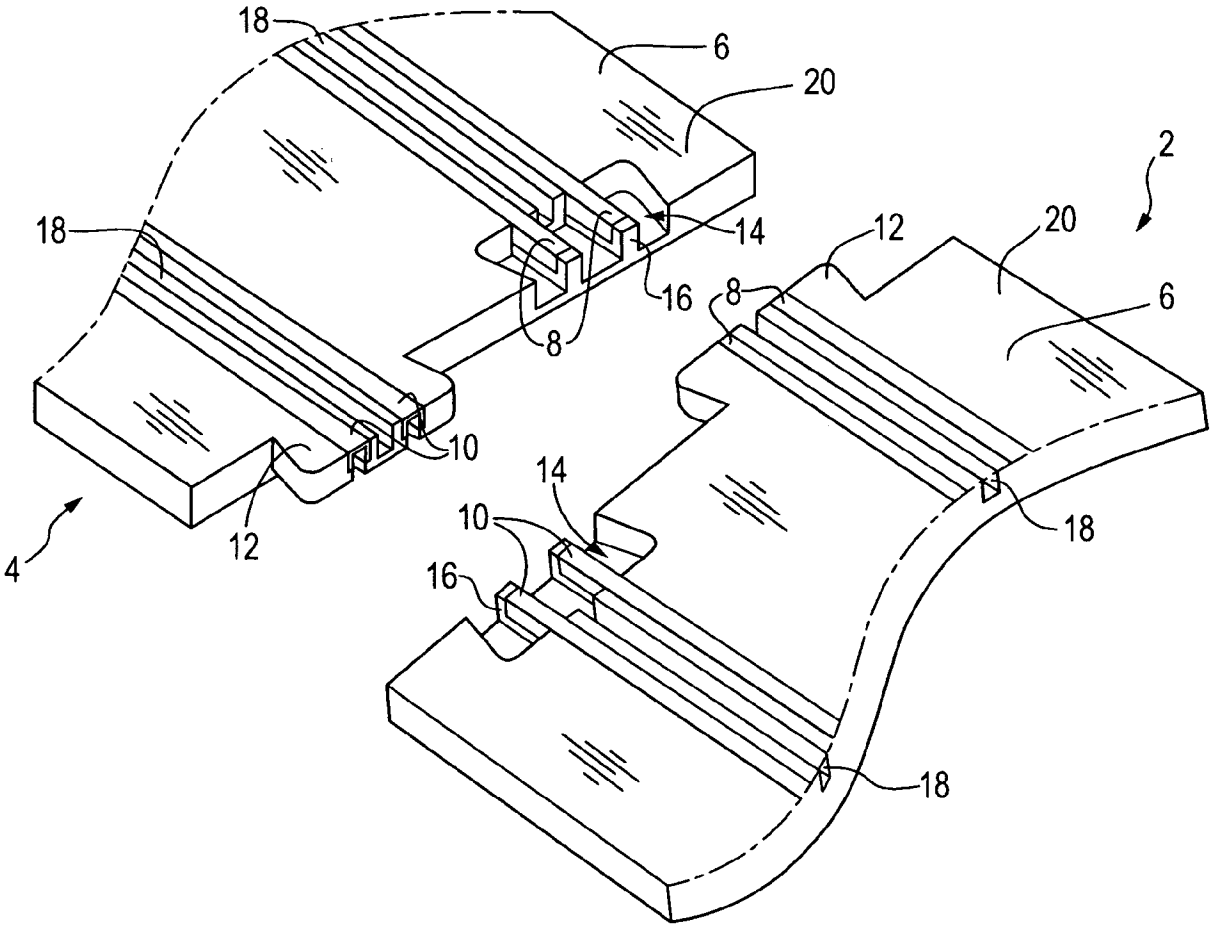
FIG. 1 illustrates a perspective view of facing ends of a first rail board and a second rail board in accordance with an embodiment of the invention.
Figure 2:
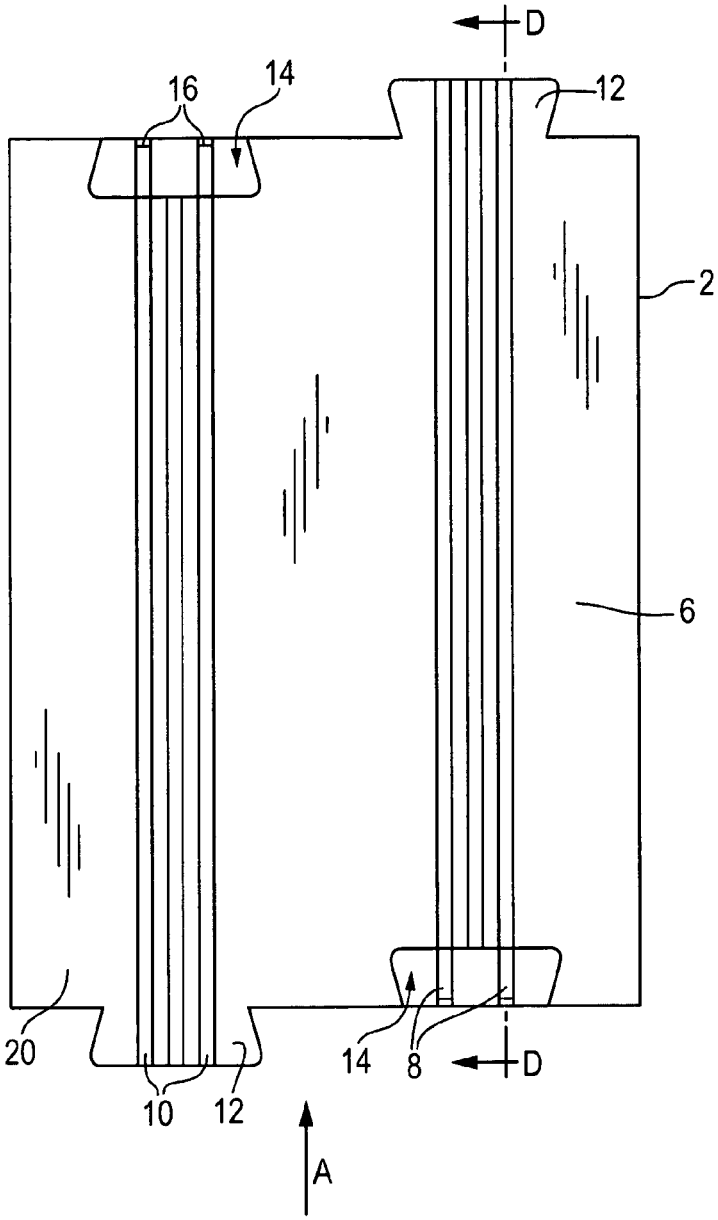
FIG. 2 illustrates a plan view of the first rail board of FIG. 1.
Figure 4:
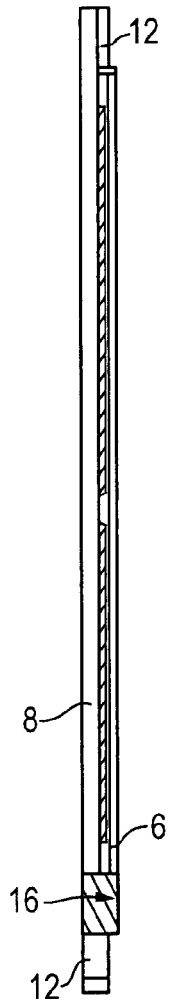
Figure 3:
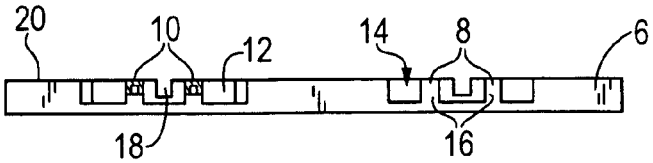
FIG. 3 illustrates an end view of the first rail board of FIG. 2, taken from direction A.

Referring now more particularly to the drawings, FIG. 1 illustrates a perspective view of facing ends of a first and second rail board. In FIG. 1, rail boards 2, 4 each include a base 6 and at least one rail extending along the base 6. The at least one rail is shown in FIG. 1 as a first pair of rails 8 and a second pair of rails 10 extending the length of the base 6. Base 6 may have a rectangular shape, or any other shape that may support the first pair of rails 8, the second pair of rails 10, or the first and second pairs of rails 8, 10.

Each base 6 may further comprise a projection 12 located at a first end of the first pair of rails 8 and a socket 14 located at the second end of the first pair of rails 8. Therefore, each end of the base 6 may comprise a projection 12 or a socket 14. Alternatively, each base 6 may include a projection 12 at a second end of the second pair of rails 10 and a socket 14 at the first end of the second pair of rails 10. Therefore, each end of the base 6 may comprise a projection 12 and a socket 14. In this configuration, the projection 12 at the end of the first pair of rails 8 would be at the opposite end of the base to the projection 12 at the end of the second pair of rails 10.

A substantial portion of the projection 12 has an outwardly tapered profile which is substantially a trapezium having a longer parallel edge distal the first end of the base and a shorter parallel edge adjacent the first end of the base. As such, the parallel edges taper outwards from the first end of the base 6 towards the distal end of the projection 12.

The projection 12 may be provided by an integral extension of the base 6. Alternatively, the projection may be provided by a separate element fixedly attached to the base 6. The separate element may include attachment means for connecting the separate element to the base 6, for example, one or more protrusions designed to fit into openings on the end of the base 6.

The sockets 14 may have shapes and dimensions that substantially correspond to the projections 12. The sockets 14 may be provided by an indentation in the base 6. The indentation provides an opening in the upper surface 20 of the base 6 and maintains a bottom in the socket 14. Because the indentation does not extend through the base 6, the bottom of the socket 14 may be provided by a portion 22 (see FIG. 5) of the base 6.

The base 6 includes a contact to connect the rail of one rail board with the rail of another rail board, for example. The contact may be located in the socket or alternatively, the contact may be provided by a spigot extending from one of the rails 8, 10 into the socket 14. Rails 8, 10 may extend into the sockets 14 to provide a contact for connection of the rails on the first board 2 with the rails on the second board 4. The rails 8, 10 may extend along the projections 12. A closure 16 may be provided at the end of each rail 8, 10 and at the edge of the socket 14 or alternatively, the end of the rail 8, 10 at the edge of the projection may be left open. The section of rail 8, 10 that extends across the socket 14 may have slightly smaller dimensions than the rest of the rail to allow the rail of the projection 12 to fit over the rail in the socket 14.

Alternatively, or in addition, the contact may be provided by an extension of the rail. In this case, the contact section of the rail may have reduced dimensions relative to the rest of the rail, to allow the rail of the connecting board to fit over the contact section of the rail. Since the contact extends into the socket it will be protected by the surrounding base of the rail board and therefore less likely to be damaged than the prior art devices referred to above.

The rails 8, 10 may be suitably provided by a substantially U-shaped extrusion. The rail and the contact may have any dimensions, but the dimensions of the rail and the contact can be suitably chosen such that, in use, the rail extending along the projection 12 fits over the contact extending into the socket 14 when adjacent rail boards are connected together.

Figure 5:
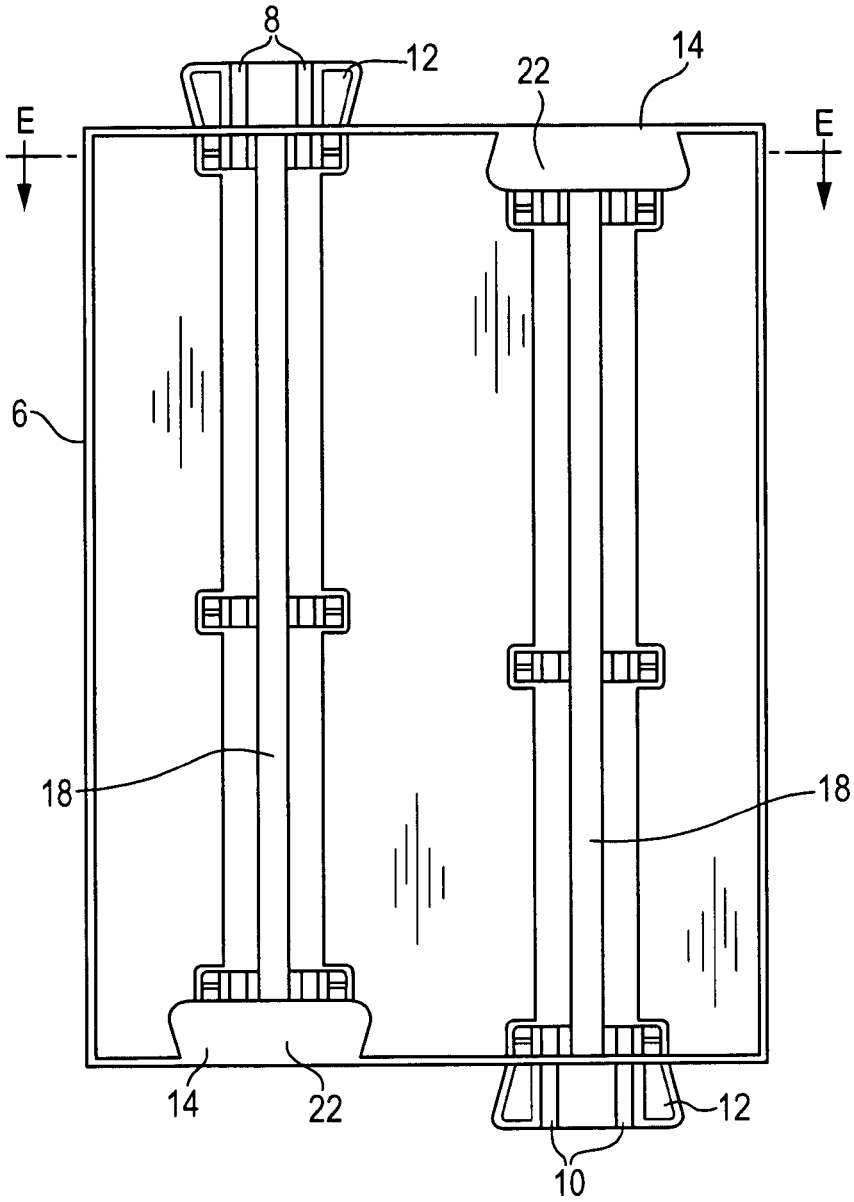
FIG. 5 illustrates a view from underneath the first rail board of FIGS. 1–4.
Figure 6:
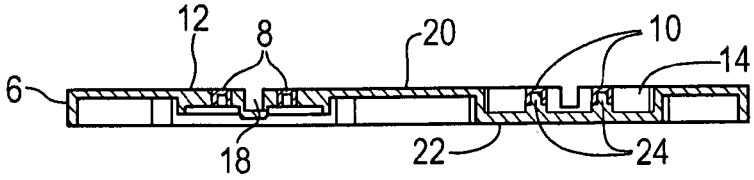
FIG. 6 illustrates a cross-section view of the first rail board taken along the line E—E of FIG. 5.

The rails 8, 10 and the contact may comprise any suitable material, for example, metal if the rail is intended to be electrically conductive. As illustrated in FIGS. 5 and 6, the base 6 or a part thereof may be provided by a hollow molded plastic material. The projection 12 may be provided by an extension of the base 6 and the rails 8, 10 are supported in the projection 12. In this embodiment, the base is thicker in the region in which the rails are supported. In the projection 12, there may be an opening in the base 6 below the rails 8, 10 to permit the rails to fit over the rails 8, 10 in the socket 14 when the boards 2, 4 are fitted together. In this case, the opening providing the socket 14 may be suitably provided by an indentation or recessed portion formed in the base 6.

Alternatively, the base or a part thereof may be solid with the opening in the surface providing the socket 14 having a cutaway section of the solid base.

In FIG. 5, the socket 14 may be provided by a molded indentation in the base 6. The socket 14 can be formed by other manufacturing methods as well, for example, stamping if the base 6 is metal. In FIG. 6, the bottom 22 of the socket 14 may have molded projections 24 for supporting the rails 8, 10.

The rail may be embedded into the base. In which case, the base suitably comprises a channel 18 in the board adjacent the rail, to allow contact of a model vehicle, for example, with the rail. Alternatively, the rail may be provided separately from the base and operatively connected therewith by a suitable fastener, such as adhesive or bonding material.

As briefly described above, the base 6 may be any suitable shape. For example, the rail board 2, 4 may be substantially rectangular in shape, either substantially straight or curved, or the rail board 2, 4 may have a substantially U-shaped, X-shaped or L-shaped configuration or the rail board may have a substantially circular, oblique, elliptical, triangular, square or other polygonal shape. Suitably, the first end of the base is opposite the second end of the base. No matter its shape, the base 6 can be formed into a smooth configuration such that the base does not have any sharp edges, points or areas.

The opening providing the socket is suitably located in the surface of the base in which the rail is located. The profiles of the opening suitably corresponds substantially with the profile of the protrusion. The opening providing the socket may not extend through the full depth of the base such that the socket 14 comprises a bottom wall. The bottom wall may be provided by the base 6 of the rail board 2, 4.

In an alternate embodiment, a rail board according to the invention may comprise a plurality of projections and corresponding sockets. If the board comprises a plurality of projections, the rail board may comprise a plurality of projections at one end of the base and a corresponding number of sockets at the other end of the base. Alternatively, one or more of the projections may be located at the first end of the base, while the remaining projection or projections may be located at the second end of the base. Each board 2, 4 may comprise a projection 12 and an adjacent socket 14 at the first end of the board and a projection 12 and an adjacent socket-14 at the second end of the base. The board may comprise a series of two or more adjacent projections 12 next to a series of one or more sockets 14 at one end, with a corresponding arrangement of sockets 14 and projections 12 at the other end of the board 2, 4.

In another embodiment, a rail board according to the present invention may comprise a plurality of rails or a single pair of rails. The rail board may comprise a plurality, for example, two or more, pairs of rails. Suitably, the rail board comprises one projection 12 and one socket 14 for each pair of rails.

For example, if the rail board comprises two or more pairs of rails, the first end of the base may comprise a projection for the first pair of rails and a socket for the second pair of rails. In this case, the second end of the base suitably comprises a socket for the first pair of rails and a projection for the second pair of rails.

The present invention further provides a method of connecting a first and second rail board. The method includes arranging the first and second rail boards such that the socket of the first rail board faces the projection of the second rail board. The second rail board may be aligned relative to the first rail board such that the projection of the second rail board is above the socket of the first rail board. The first rail board may be connected to the second rail board by cooperatively engaging the projection of the second rail board with the socket of the first rail board such that one end of the first rail board abuts the opposite end of the second rail board. This connection aligns the at least one rail extending along the first rail board with the at least one rail extending along the second rail board.

Because the base of the first rail board and the base of the second rail board may comprise a projection and a socket extending from each end of the base, the aligning of the second rail board relative to the first rail board may include twisting, rotating, or positioning one of the first and second rail boards relative to the other of the first and second rail boards such that the projection of the first rail board is above the socket of the second rail board and the projection of the second rail board is above the socket of the first rail board. The first rail board may be aligned with the second board, or vice versa, by elevating the first board relative to the second board, for example.

In use of the rail boards 2, 4 opposite ends of the boards 2, 4 are brought together. One or both of the boards 2, 4 may be twisted, rotated or positioned so that each projection 12 on one board is above a corresponding socket 14 on the other board. The boards 2, 4 are then brought into contact with one another so that the projections 12 fit into the sockets 14. In this arrangement, the open ends of the rails 8, 10 on the projections 12 will fit over the closed ends of the rails 8, 10 in the socket 14.

If the rail board comprises one projection and one adjacent socket at each end of the base, then the second rail board can be aligned relative to the first rail board by twisting, rotating or positioning the second rail board relative to the first rail board such that the projection of the first rail board is above the socket of the second rail board and the projection of the second rail board is above the socket of the first rail board. After being aligned with the second rail board, the first rail board can be connected to the second rail board by cooperatively engaging the projection of the second rail board with the socket of the first rail board and the socket of the second rail board with the projection of the first board. As a result, one end of the first rail board will abut the opposite end of the second rail board to align the at least one rail extending along the first rail board with the at least one rail extending along the second rail board.

Twisting, rotating or positioning the second rail board relative to the first rail board may also be used with a first and second rail board each comprising a series of, two or more projections next to one or more adjacent sockets at a first end of the board and a corresponding series of two or more sockets next to one or more adjacent projections at the second end of the board. Such twisting, rotating or positioning provides a strong connection between adjacent rail boards. As a result, the boards can be moved or lifted without being separated from one another.

Connecting the first and second rail boards with one another may include connecting the rail of the first rail boards with the rail of the second rail board. If the first and second rail boards comprise a plurality of rails, each rail of the first rail board can be contacted and connected with a corresponding rail of the second rail board.

The invention provides a rail board which is easily connected to another similar rail board, wherein the connection is tight and secure. The projection and socket arrangement of each rail board provides strong rail connections. As such, the rail connections are less likely to get damaged if the board is dropped, for example. The tapered shape of the projections and the sockets allows adjacent boards to be connected and secured tightly and are not likely to loosen in use.

Since numerous modifications and changes to the embodiments described above may occur to those of ordinary skill in the art, it is not desired to limit the invention to the exact construction and operation illustrated and described. Accordingly, all suitable modifications and equivalents should be considered as falling within the spirit and scope of the invention.

For example, the various features of the invention, which are described in the contents of separate embodiments for the purpose of clarity, may also be combined in a single embodiment. Conversely, the various features of the invention which are described in the context of a single embodiment may also be provided separately or in any suitable sub-combination.

The foregoing detailed description has been provided to illustrate the structural and functional principles of the present invention and is not intended to be limiting. To the contrary, the present invention is intended to encompass all alterations, modifications, and substitutions within the spirit and scope of the following claims.

What is claimed is:

1. A rail board comprising:

a base having a projection extending from a first end of the base to an end of the projection and a socket provided by an opening formed in a surface of the base at a second end of the base; and at least one rail extending along the base from the end of the projection to the second end of the base, wherein the projection tapers from narrow to wide in width from the first end of the base to the end of the projection.

2. A rail board according to claim 1, wherein the base includes an extension that at least partially forms the projection.

3. A rail board according to claim 1, wherein the at least one rail includes a contact to connect the at least one rail to at least one rail of another rail board.

4. A rail board according to claim 3, wherein the contact is located in the socket.

5. A rail board according to claim 3, wherein the contact is provided by a spigot extending from the at least one rail.

6. A rail board according to claim 3, wherein the contact is provided by an extension of the at least one rail.

7. A rail board according to claim 1, wherein the base or a part thereof is solid and the opening comprises a cutaway section formed in the base.

8. A rail board according to claim 1, wherein the base or a part thereof is hollow and the opening comprises an indentation in the surface of the base.

9. A rail board according to claim 1, wherein the at least one rail is located in the surface of the base.

10. A rail board according to claim 1, further comprising at least one other rail extending along the base or a part thereof.

11. A rail board according to claim 10, wherein the base further comprises at least one additional projection and at least one additional socket for each rail provided thereon in addition to the at least one rail, wherein the at least one additional projection is provided on the first end or the second end of the base and the at least one additional socket is provided on an opposite end of the base, opposite the at least one additional projection.

12. A rail board according to claim 1, wherein the rail board includes a single pair of rails.

13. A rail board according to claim 1, wherein the rail board includes two pairs of rails.

14. A rail board according to claim 1, further comprising at least one additional projection extending from the first end of the base and at least one additional socket formed in the second end of the base.

15. A rail board according to claim 14, further comprising at least one additional rail extending from the at least one additional projection to the at least one additional socket.

16. A rail board according to claim 1, further comprising at least one additional rail extending along the base from the first end thereof to the second end thereof, wherein the base further comprises at least one additional projection and at least one additional socket for each additional rail provided in addition to the at least one rail.

17. A rail board according to claim 16, wherein the at least one additional projection is provided adjacent the socket and extends from the second end of the base and the at least one additional socket is provided adjacent to the projection and is formed in the first end of the base.

18. A method of connecting a first rail board to a second rail board, the first and second rail boards each comprising a base having a projection extending from a first end of the base to an end of the projection, said projection tapering from narrow to wide in width from the first end of the base to the end of the projection, and a socket formed in an opposite end of the base and at least one rail extending along the base from the end of the projection to the opposite end of the base, the method comprising:

arranging the first and second rail boards such that the socket of the first rail board faces the projection of the second rail board;

aligning the second rail board relative to the first rail board by cooperatively rotating one of the first and second rail boards relative to the other of the first and second rail boards such that the projection of the second rail board is above the socket of the first rail board; and connecting the first rail board to the second rail board by cooperatively engaging the projection of the second rail board with the socket of the first rail board such that one end of the first rail board abuts the opposite end of the second rail board to align the at least one rail extending along the first rail board with the at least one rail extending along the second rail board.

19. A method according to claim 18, wherein the base of the first rail board and the base of the second rail board further comprise a projection extending from the opposite end thereof and a socket formed in the one end thereof, the aligning of the second rail board relative to the first rail board includes positioning one of the first and second rail boards relative to the other of the first and second rail boards such that the projection of the first rail board is above the socket of the second rail board and the projection of the second rail board is above the socket of the first rail board.

20. A method according to claim 19, further comprising connecting the first rail board to the second rail board by cooperatively engaging the projection of the second rail board with the socket of the first rail board and the socket of the second rail board with the projection of the first board such that one end of the first rail board abuts the opposite end of the second rail board to align the at least one rail extending along the first rail board with the at least one rail extending along the second rail board.

21. A method according to claim 18, further comprising connecting the at least one rail extending along the first rail board with the at least one rail extending along the second rail board.

22. A method according to claim 18, further comprising connecting each rail of the first rail board with a corresponding rail of the second rail board.

* * * * *